United States Patent [19]

Hashimoto

[11] Patent Number: 4,667,483

[45] Date of Patent: May 26, 1987

[54] AIR CONDITIONER

[75] Inventor: Yasuhiko Hashimoto, Fujieda, Japan

[73] Assignee: Mitsubishi Denki Kabushiki Kaisha, Tokyo, Japan

[21] Appl. No.: 792,837

[22] Filed: Oct. 30, 1985

[30] Foreign Application Priority Data

Nov. 13, 1984 [JP] Japan ..... 59-172102[U]

[51] Int. Cl.[4] ..... F25D 23/12

[52] U.S. Cl. ..... 62/262; 98/94.2

[58] Field of Search ..... 98/101, 114, 94.2; 62/298, 262

[56] References Cited

U.S. PATENT DOCUMENTS 3,391,629 7/1968 Snell ..... 98/114

3,576,114 4/1971 Sharp et al. .

4,205,597 6/1980 Nawa et al. .

4,586,349 5/1986 Ohishi ..... 98/94.2

*Primary Examiner*—Henry Bennett

*Attorney, Agent, or Firm*—Oblon, Fisher, Spivak, McClelland & Maier

[57] ABSTRACT

In an air conditioner having an air conditioner body being insertable into an opening formed in a wall plate, the air conditioner body comprising a casing provided with flanges for fixing the body at a front circumferential part, and a front panel attached to the front opening of the casing, the width of the front panel is greater than the width of the casing and decoration covers extending vertically to cover the flanges are provided at the front of the air conditioner body.

6 Claims, 6 Drawing Figures

AIR CONDITIONER

BACKGROUND OF THE INVENTION

The present invention relates to an integral type air conditioner to be installed in an opening of a wall plate.

Heretofore, an air conditioner of such type has a construction as shown, for instance, in FIG. 6 of Japanese Unexamined Utility Model Publication No. 73885/1983. In FIG. 6 of Japanese Publication, a reference numeral 1 designates a unit to be placed at the side of a room, a numeral 2 designates a unit to be placed at the outdoor side, a numeral 3 designates an air conditioner body comprising a casing 5 provided with vertical and lateral flanges 4 for fixing the casing 5 at its the front circumferential part and a front panel 6 attached to a front opening part 5*a* of the casing 5, a numeral 7 designates a partition plate for separating the casing 5 into the room side unit 1 and outdoor side unit 2, a numeral 8 designates a cooling device constituting the room side unit 1, numerals 9 and 10 respectively designate a condenser and a compressor which constitute the outdoor side unit 2, a numeral 11 designates a base plate for supporting the room side unit 1 and the outdoor side unit 2, numerals 12 and 13 respectively designate an intake port and an outlet port provided in the front panel 6, and a numeral 14 designates a wall plate which has an opening 15 and is used to separate a room from the outdoor.

Installation of the air conditioner having the construction as above-mentioned is carried out in such a manner that the casing 5 is inserted in the opening 15 of the wall plate 14; flange pieces 4*a* of the vertical and lateral flanges 4 are forced to come into contact with the circumference 15*a* of the opening 15 followed by knocking drive screws (not shown) to thereby secure the casing 5 to the wall plate 14; the base plate 11 on which the room side unit 1 and the outdoor side unit 2 are mounted is slipped in the casing 5, and thereafter, the front panel 6 is attached to the room side unit 1.

The conventional air conditioner, however, has disadvantages that a ratio of the longitudinal dimension to the transverse dimension in the front area of the front panel 6 is limited by dimensions of the front area of the casing, whereby it is difficult to design the air conditioner as desired. Another disadvantage is that appearance of the air conditioner is poor because the vertical and lateral flanges 4 for fixing the casing 5 are visible from the side of a room.

SUMMARY OF THE INVENTION

It is an object of the present invention to provide an air conditioner for permitting a desired design of the front panel by a designer and having excellent appearance.

The foregoing and the other objects of the present invention have been attained by providing an air conditioner provided with an air conditioner body which is insertable in an opening formed in a wall plate, the air conditioning body comprising a casing with vertical and lateral flanges for fixing the body at its front circumference and a front panel attached to an opening part at the front of the casing, the air conditioner being characterized in that the width of the front panel is made greater than the width of the casing to form closing parts at its both sides so that the closing parts face and cover the lateral flanges, and decoration covers, having at least one recess, are arranged at upper and lower edge surfaces of the front panel to cover the vertical flanges.

BRIEF DESCRIPTION OF THE PREFERRED EMBODIMENTS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
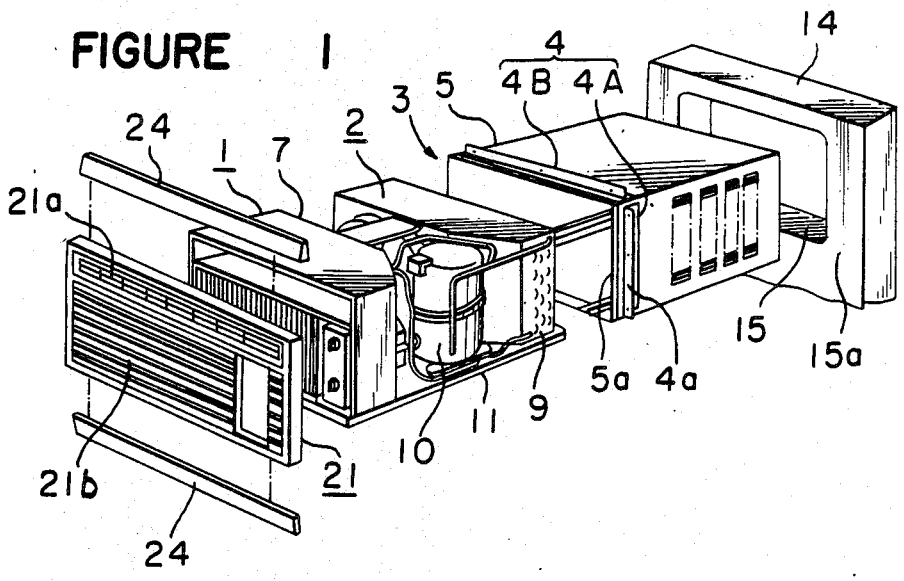
FIG. 1 is a perspective view in a disassembled state of an embodiment of the air conditioner according to the present invention.
Figure 2:
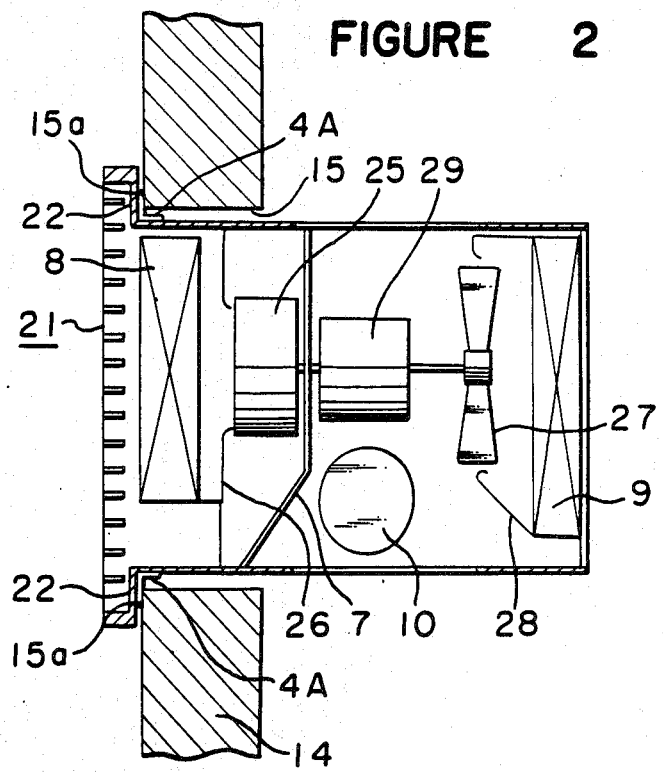
FIG. 2 is a longitudinal cross-sectional view of an embodiment of the air conditioner of the present invention.
Figure 3:
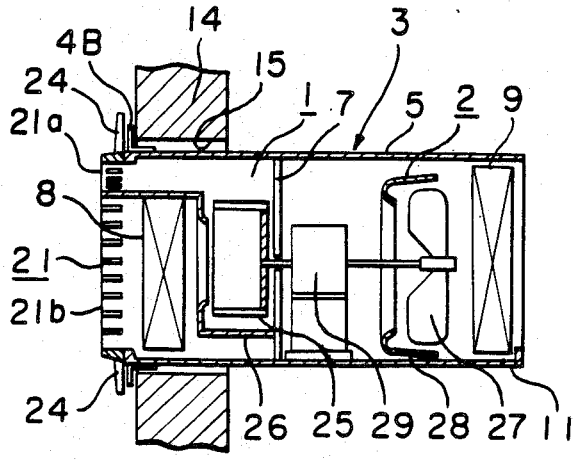
FIG. 3 is a longitudinal cross-sectional view showing another embodiment of the present invention.
Figure 4:
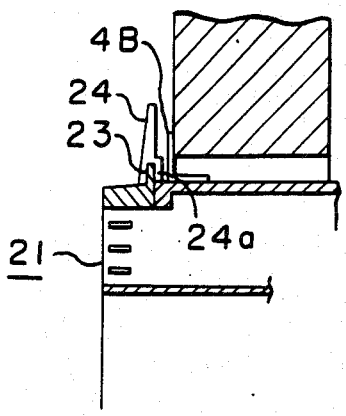
FIG. 4 is an enlarged cross-sectional view of the other embodiment of the present invention.

Preferred embodiments of the present invention will be described with reference to FIGS. 1 to 5. In the Figures, the same reference numerals designate the same or corresponding parts and therefore, description of these parts is omitted.

A reference numeral 21 designates a front panel having an air outlet port 21*a* at the upper portion and an air intake port 21*b* at the lower portion and is adapted to be attached to a front opening part 5*a* of the casing 5. The front panel 21 is formed in such a manner that the width of the panel 21 is greater than the width of the casing 5; the air outlet port 21*a* and the air intake port 21*b* occupy a part of the front surface of the front panel, and there are provided a pair of covering portions 22 which oppose flange pieces 4*a* of the lateral flanges 4A provided at both sides of the casing 5 at the reverse side of the front surface of the front panel 21. Namely, the front panel 21 is formed to have a dimesion greater than a length obtained by summing the width of the casing 5 and two times of the height of the flange 4A.

At least one projection 23 is formed integrally with each of the upper and lower edge of the front panel 21 to extend in the transverse direction. Reference numerals 24 designate a pair of decoration covers for covering the vertical flanges 4B provided at the upper and lower front parts of the casing 5. Each of the decoration covers 24 has a pawl portion 24*a* having a U-shape in cross-section which is fitted to the projection 23 so that the decoration covers 24 are placed on and under the front panel 21. Each of the decoration covers 24 has a thickness smaller than that of the front panel 21. The covers are located at positions near the wall plate 14. The decoration covers may be colored to harmonize color of the wall plate 14 to improve effect in design.

In FIGS. 1 to 5, reference numerals 25 and 26 respectively designate a blower for the room interior side and a blower casing which constitute the room side unit 1, numerals 27, 28 and 29 respectively designate a blower for the outdoor side, a guide plate for guiding air and a motor which all constitute the outdoor side unit 2.

Installation of the air conditioner having the construction as above-mentioned in a cavity formed in the wall plate 14 is carried out as follows. The casing 5 is inserted in the opening 15 of the wall plate 14; the flange pieces 4*a* of the lateral flanges 4A are forced to the circumference 15*a* of the opening 15; drive screws (not shown) are knocked to the wall plate 14 through apertures formed in the flange pieces 4*a* to thereby secure the casing 5; the base plate 11 on which the room side unit 1 and the outdoor side unit 2 are mounted is slipped in the casing 5; the front panel 21 is attached to the front opening part 5*a* of the casing, and the pawls 24*a* of the decoration covers 24 are fitted to the projections 23 to attach the decoration covers on and under the front panel 21.

Figure 5:
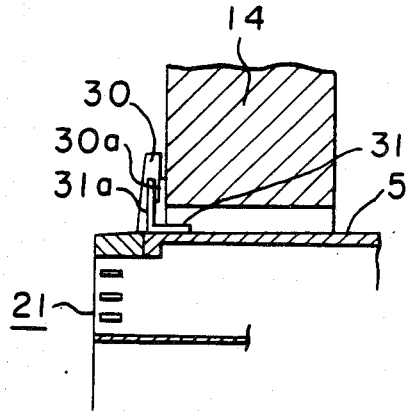
FIG. 5 is an enlarged cross-sectional view of still another embodiment of the present invention.
Figure 6:
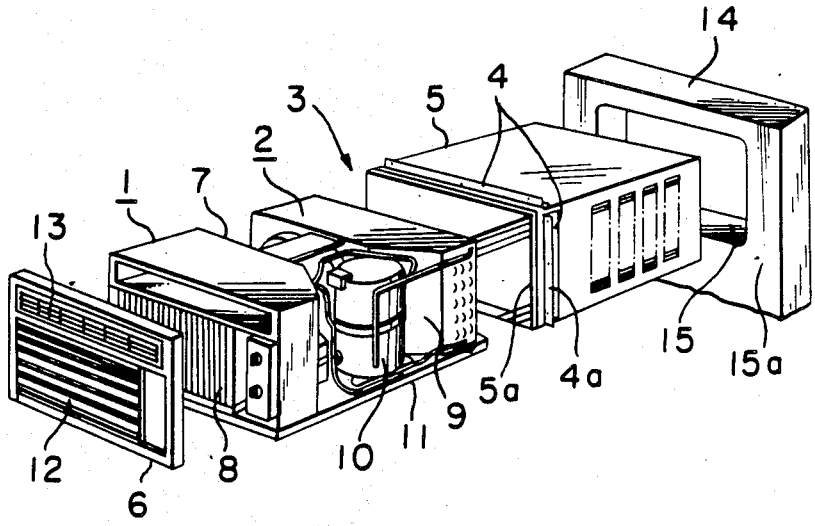
FIG. 6 is a perspective view in a disassembled state of a conventional air conditioner.

In the embodiment as above-mentioned, the decoration covers 24 are attached to the front panel 21 by fitting the pawls 24*a* to the projections 23 provide on the front panel 21. However, the present invention is not limited to the above-mentioned embodiment, but it is possible that pawls 30*a* defining recesses, are fitted to fitting parts 31*a* of flanges 31 connected to the front part of the casing 5 as shown in FIG. 5. In this case, the front panel 21 is attached to the front opening part 5*a* of the casing 5 after the decoration covers 30 are attached to the flanges 31 for fixing the casing 5. Accordingly, a gap formed between the front panel 21 and the wall plate 14 which is produced in the installation of the air conditioner is closed even though a position of the flanges 31 is changed to some extent.

Further, in the above-mentioned embodiment, the decoration covers 24 are separately prepared from the front panel 21. However, the same effect can be obtained by forming the decoration covers integrally with the front panel.

Thus, in accordance with the present invention, the width of the front panel to be attached to the front opening part of the casing is made greater than the width of the casing and decoration covers for covering the vertical flanges are attached to the air conditioner body, whereby a desired design can be applied to the front panel since there is no restriction in design of the front panel. Further, vertical and lateral flanges for fixing the casing can be covered by the front panel and the decoration covers, whereby there is obtainable excellent appearance in view of the room interior side and effect in design is further improved.

I claim:

1. An air conditioner comprising:

an air conditioner body which is insertable in an opening formed in a wall plate, said air conditioner body including a casing with outwardly extending vertical and lateral flanges for fixing said body at a front circumference thereof; and a front panel attachable to an opening part at the front of said casing, wherein:

(a) the width of said front panel is made greater than the width of said casing to form closing parts at both sides thereof so that said closing parts face and cover said lateral flanges, (b) decoration covers are arranged at upper and lower edge surfaces of said front panel to cover said vertical flanges, and (c) each of said decoration covers is provided with at least one lateral recess compfising means for securement of said decoration cover to one of said front panel and said vertical flanges of said casing.

2. An air conditioning according to claim 1, wherein said vertical and lateral flanges are provided at the front circumferential part of said casing, and said flanges are connectable to the circumference at the room interior side of said opening part of the wall plate.

3. An air conditioner according to claim 1, wherein said front panel is provided with at least one projection on each of upper and lower edge surfaces so as to face said vertical flanges, wherein said projections are fittable in said at least one recess, and wherein each of said decoration covers is provided with a pawl defining a portion of said at least one recess so that said decoration covers may be attached to said front panel by fitting said projections to said at least one recess.

4. An air conditioner according to claim 1, wherein said vertical flanges are each provided with a fitting part for supporting said decoration covers, and said decoration covers are each provided with a pawl defining a portion of said at least one recess, whereby said decoration covers are attached to said vertical flanges by fitting said pawls to said fitting parts, and side edges of said decoration covers are in contact with the upper and lower edge surfaces of said front panel when said pawls are fitted to said fitting parts.

5. An air conditioner according to claim 1, wherein said decoration panel has a thickness smaller than that of said front panel.

6. An air conditioner according to claim 1, wherein the width of said front panel is greater than a length provided by summing the width of said casing and two times of the height of said lateral flange.

* * * * *